United States Patent [19]

Sone et al.

[11] Patent Number: 4,723,088

[45] Date of Patent: Feb. 2, 1988

[54] SUPPORT MEMBERS FOR THE MASK FRAME OF A CRT

[75] Inventors: Toshinao Sone, Kumagaya; Michio Nakamura, Saitama, both of Japan

[73] Assignee: Kabushiki Kaisha Toshiba, Kawasaki, Japan

[21] Appl. No.: 844,553

[22] Filed: Mar. 27, 1986

[30] Foreign Application Priority Data

Mar. 29, 1985 [JP] Japan ..... 60-63834

[51] Int. Cl.[4] ..... H01J 29/07

[52] U.S. Cl. ..... 313/404; 313/407

[58] Field of Search ..... 313/402, 404, 407

[56] References Cited

U.S. PATENT DOCUMENTS 3,529,199 9/1970 Duistermaat et al. ..... 313/404
3,999,098 12/1976 Dougherty ..... 313/407

FOREIGN PATENT DOCUMENTS 1571238 6/1969 France .
5741176 6/1977 Japan .
159166 12/1979 Japan ..... 313/404
57-53047 3/1982 Japan .
60-12736 4/1985 Japan .
2097996 11/1982 United Kingdom .

*Primary Examiner*—David K. Moore
*Assistant Examiner*—K. Wieder
*Attorney, Agent, or Firm*—Cushman, Darby & Cushman

[57] ABSTRACT

In a color cathode ray tube, a shadow mask is supported by a mask frame and is so arranged in a panel section of an envelope as to face a phosphor screen formed on an inner surface of a face plate of the panel section. The mask frame has four flat corner sections which are arranged substantially parallel to an axis of the envelope, and is coupled to a skirt section of the panel section through a stud pin by support members which are fixed to the flat corner sections, respectively. Each of the support members has a resiliently deformable structure which is provided with a straight deformable plate section and first and second plate sections extending from both ends of the straight deformable plate section. The first section is fixed to the flat corner section and the second section is coupled to the stud pin.

10 Claims, 7 Drawing Figures

SUPPORT MEMBERS FOR THE MASK FRAME OF A CRT

BACKGROUND OF THE INVENTION

The present invention relates to a shadow mask assembly of a color cathode ray tube and, more particularly, to an improvement in a structure for supporting a shadow mask inside a skirt of a panel.

In a conventional shadow mask type color cathode ray tube, shadow mask 26 having a plurality of small slit-like apertures 21 and being made of a thin metal plate, as shown in FIG. 1, is welded and fixed on rectangular frame 27. Shadow mask assembly 20 has resilient deformable support 28 welded and fixed at substantially a central portion of each side of frame 27, and is arranged in a glass panel (not shown). A hole formed at a distal end of each support 28 is fitted with a stud pin (not shown) fixed at an inner surface of the glass panel so as to suspend and hold assembly 20 at a predetermined position inside the panel. In assembly 20, outer surfaces of corners of frame 27 are curved for the sake of easy making.

In a system recently proposed, a resilient support is fixed not at the central portion of each side of a rectangular frame but at each corner, a stud pin is provided on the inner surface of the glass panel to correspond to each corner, and the support is engaged with the stud pin, thereby holding the shadow mask within the panel.

When a resilient deformable support is fixed at a corner of a rectangular frame and the outer surface of the corner is curved, part of the support must be curved to substantially correspond to the corner of the frame so that the support can be brought into tight contact therewith and be firmly fixed thereon. However, it is difficult to work a resilient deformable support of such a shape. In addition, since the support is curved, its elasticity becomes excessive, i.e., its spring back force becomes too large. As a result, loading/unloading of the shadow mask, which is repeated several times during manufacture of a color cathode ray tube, becomes difficult. In order to prevent this, the resilient deformable support is made to have a complex shape, or an auxiliary member is needed in addition to the frame and the support, as shown in Japanese Pat. Disclosure No. 57-187839. This leads to an increase in manufacturing costs as well as displacement of the shadow mask caused upon repeated loading/unloading thereof. Such displacement of the shadow mask should be avoided in a color cathode ray tube.

SUMMARY OF THE INVENTION

It is an object of the present invention to provide a color cathode ray tube wherein a resilient deformable support of a simple shape is employed, displacement of a shadow mask provided with the support, which is caused by repeated loading/unloading thereof during manufacture of the tube, can be minimized, and the resilient deformable support can be firmly fixed to a mask frame.

According to the present invention, there is provided a color cathode ray tube comprising:

a vacuum envelope with an axis and including a panel section, a funnel section and a neck section, said panel section having a faceplate, a front view shape of which is substantially rectangular and which has an inner surface, and a skirt with a peripheral inner surface extending from a peripheral edge of said faceplate, said funnel section being contiguous to said skirt of said panel section, and said neck section being contiguous to said funnel section;

a phosphor screen formed on said inner surface of said faceplate;

an electron gun assembly, arranged in said neck section, for emitting electron beams to be landed on said phosphor section;

a shadow mask arranged in said panel section to oppose said phosphor screen and having a large number of apertures for allowing passage of electron beams therethrough;

a mask frame for supporting said shadow mask, including corner sections, each of which has a flat outer surface; and support members for supporting said mask frame on said peripheral inner surface of said skirt, each of said support members being provided with a straight plate section and first and second plate sections extending from both ends of said straight plate section, said first plate section being fixed to the flat corner surface of said corresponding corner section, said first plate section and said straight section defining a V-shaped structure, said second plate section being coupled to said inner surface of said skirt and said support member being resiliently deformable.

DETAILED DESCRIPTION OF THE PREFERRED EMBODIMENTS

Figure 1:
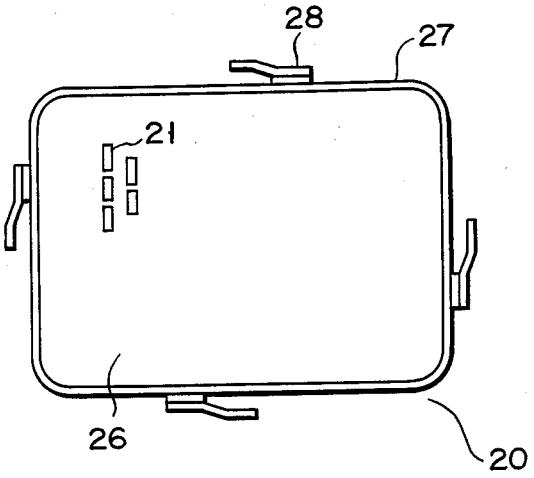
FIG. 1 PRIOR ART
FIG. 1 is a plan view schematically showing a conventional shadow mask assembly.
Figure 2:
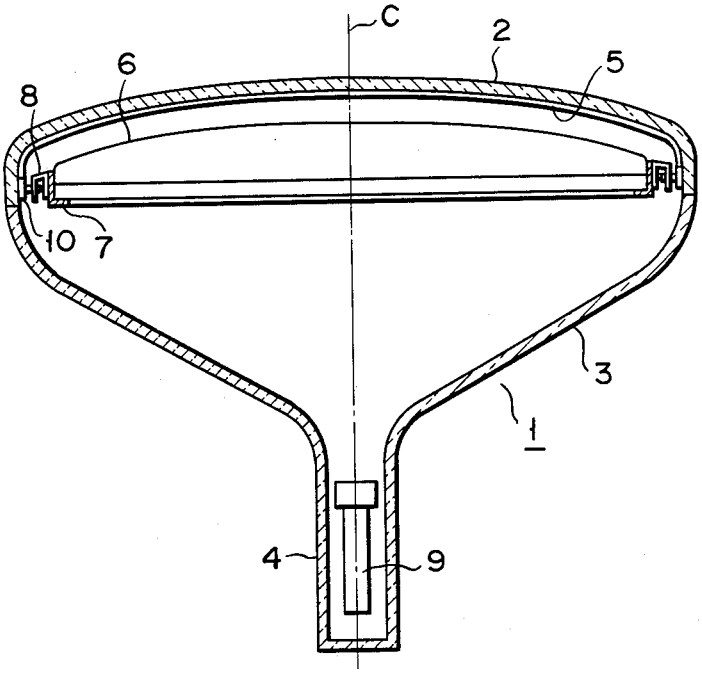
FIG. 2 is a sectional view schematically showing a color cathode ray tube according to an embodiment of the present invention.

Color cathode ray tube 1 shown in FIG. 2 is constituted by a vacuum glass envelope having substantially rectangular panel 2, funnel 3 and neck 4. Phosphor screen 5 having phosphor layers which emit blue, green and red light beams is applied inside panel 2. Rectangular shadow mask 6 having a plurality of apertures is suspended at a position in the vicinity of and opposite to screen 5. Electron gun 9 for producing a plurality of electron beams is provided in neck 4 of the color cathode ray tube. The plurality of electron beams are deflected by a deflection yoke (not shown) provided in funnel 3, cross each other near mask 6, and land on predetermined areas of screen 5. Mask 6 is welded and fixed on rectangular frame 7, on which one end of support 8 is fixed. The other end of support 8 is engaged with stud pin 10 to hold mask 6 inside panel 2.

Figure 3:
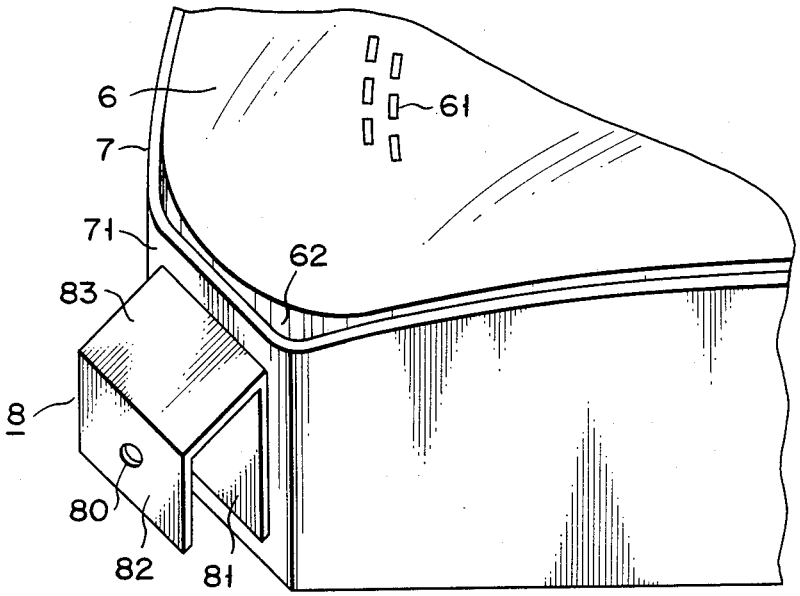
FIG. 3 is a partial perspective view schematically showing a shadow mask assembly shown in FIG. 2.
Figure 4:
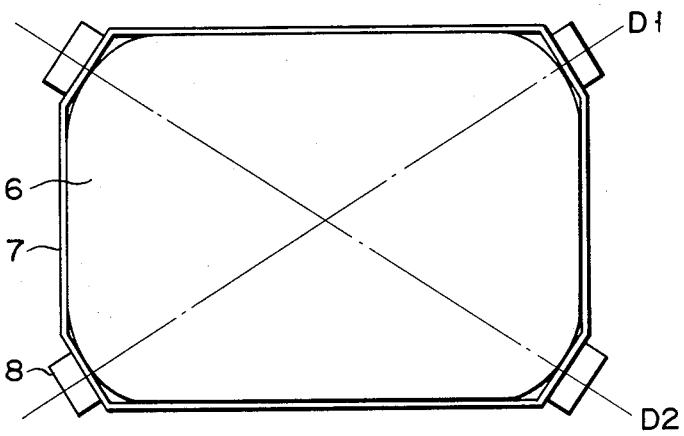
FIG. 4 is a plan view schematically showing the shadow mask assembly shown in FIG. 2.
Figure 5:
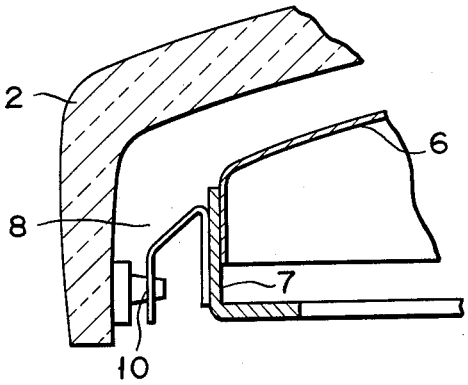
FIG. 5 is a sectional view of the shadow mask shown in FIG. 3.

FIG. 3 is a partial perspective view of the shadow mask assembly, FIG. 4 is a plan view of the shadow mask assembly, and FIG. 5 is a partial enlarged sectional view of the color cathode ray tube in which the mask assembly is suspended. Mask 6 is an iron plate with a thickness of about 0.1 to 0.3 mm, and having a plurality of slit-like apertures 61 therein. An outer surface of skirt section 62 obtained by bending a peripheral edge of mask 6 is welded and fixed to the inner surface of frame 7. Frame 7 is made of iron and has a thickness of about 0.5 to 2 mm. Flat corner section 71 having a size sufficient for mounting support 8 thereto is formed at each of four corners of frame 7 and extends substantially parallel to the tube axis. In the embodiment shown in FIGS. 2 to 5, mask 6 is slightly smaller than frame 7 and fits therein, and skirt section 62 of mask 6 is fixed to the inner surface of frame 7 by welding. Mask 6 has curved corners as shown in FIGS. 3 and 4. However, the corners of mask 6 can have a flat shape to correspond to the corner shape of frame 7. In addition, frame 7 can be slightly smaller than mask 6 and fit in skirt section 62 of mask 6, and section 62 of mask 6 can be fixed to the outer surface of frame 7 by welding.

Resilient deformable support 8 fixed to each flat corner section 71 of frame 7 is formed by bending a plate with a thickness of about 0.2 to 0.8 mm, such as SUS 631, which has a high elasticity. Each support 8 consists of fixing section 81 welded to corner section 71, engaging section 82 parallel thereto and having an engaging hole to be described below, and coupling section 83 which is bent through an acute angle with respect to section 81, to define a V-shape together therewith, and couples sections 81 and 82. Section 82 has hole 80 for engaging with pin 10 fixed to the corresponding corner of the inner surface of panel 2, as shown in FIG. 5. One end of support 8 is fixed to frame 7 and the other end thereof is engaged with pin 10, thereby holding mask 6 and frame 7 at a predetermined position inside panel 2.

In the above embodiment, flat corner section 71 of frame 7 is parallel to the tube axis. When power is supplied to the color cathode ray tube and the shadow mask assembly is heated by bombardment of electron beams, thermal expansion or the like may occur to generate a rotational moment, resulting in undesirable rotation of frame 7. In order to prevent this, the surface of corner section 71 to which support 8 is mounted is preferably substantially perpendicular to diagonal axes D1 and D2, as shown in FIG. 4.

Figure 6:
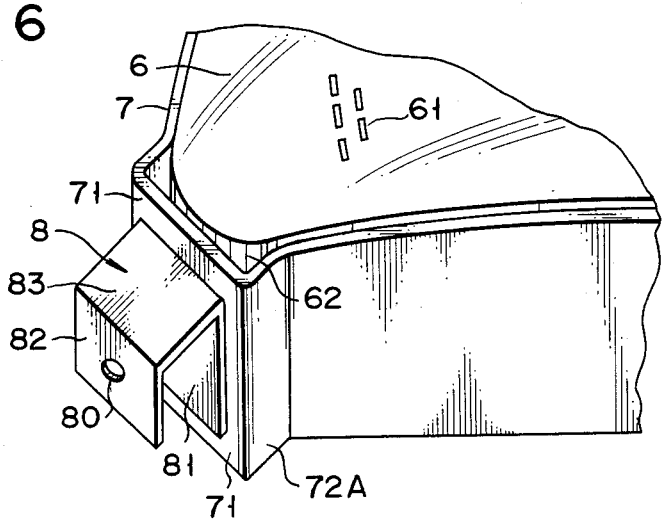
FIG. 6 is a partial perspective view schematically showing a shadow mask assembly according to another embodiment of the present invention.
Figure 7:
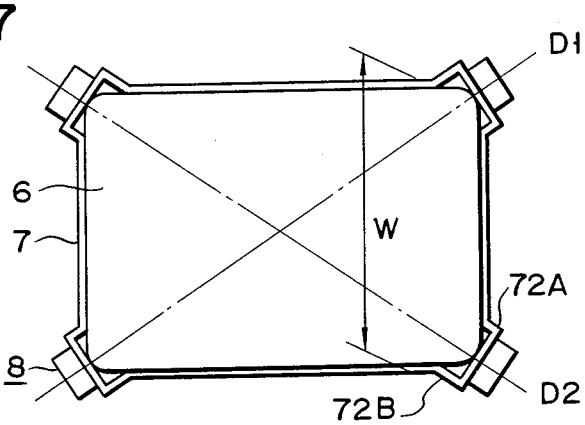
FIG. 7 is a plan view of the shadow mask assembly shown in FIG. 6.

FIGS. 6 and 7 are partial enlarged perspective views of a shadow mask assembly according to another embodiment of the present invention. The same reference numerals in FIGS. 6 and 7 denote the same parts as in FIG. 3. In this embodiment, flat corner section 71 projects outward. More specifically, a corner of rectangular frame 7 has flat corner section 71 substantially perpendicular to diagonal axis D1 or D2, and two flat side edge sections 72A and 72B substantially parallel to diagonal axis D1 or D2. Since corner section 71 projects outward, a size (W in FIG. 7) of a given portion of frame 7, excluding the corners, can be reduced. In this case, the distance between the inner surface of panel 2 and frame 7 is increased so that deformation of the shadow mask, which occurs upon abutment thereof against the panel during loading/unloading, can be reduced.

In the above embodiments, the shadow mask and the frame are made of iron. However, a material such as an invar alloy which has a low thermal expansion coefficient can be used instead. The stud pin and the resilient deformable support need not be provided at corners of the panel and the shadow mask, but can be provided in the vicinity thereof.

As described above, in the color cathode ray tube of the present invention, the corner section of frame 7 is flat. As a result, no curved portion is formed in support 8 and support 8 is reliably and firmly fixed to corner section 71 of frame 7. Since no curved portion is formed in support 8, the elasticity of support 8 can be properly set so that it can be prevented from having a large spring back force. As a result, frame 7 can be easily loaded in and unloaded from the panel and the shadow mask can be arranged at a predetermined position during manufacturing, thereby preventing mislanding of beams in the completed tube.

Furthermore, even if an external impact is applied, variations in the beam landing position can be minimized.

In the color cathode ray tube of the present invention, since the support is fixed by welding to an integral frame, the number of parts is comparatively small, resulting in a shadow mask assembly of a simple structure.

Since the number of parts is small, reliability of the shadow mask assembly is increased, and manufacturing costs are decreased.

According to the present invention, a step of fixing a support to a frame by welding can be simplified, and welding can be performed with high precision. When welding is performed, the frame and the supports are inserted in a jig having stud pins arranged at corresponding positions in the panel, and are welded. Accordingly, the supports bias the frame by a spring force immediately before welding. In the embodiment shown in FIG. 5, the contact surface of frame 7 and support 8 is parallel to the tube axis so that frame 7 is not urged toward the phosphor screen or in an opposing direction, but is fixed in position. In addition, supports 8 are in tight and stable contact with frame 7 by their own biasing force. Therefore, welding can be performed with considerable ease and high precision.

As described above, the present invention has the following advantages: (1) the frame and the supports can be fixed firmly while maintaining good loading/unloading operability, resulting in high tolerance to external impact; (2) the simplified structure provides high reliability and good beam landing characteristics; and (3) the frame and the supports are stabilized by the spring pressure of the supports during welding, allowing high precision welding.

What is claimed is:

1. A color cathode ray tube comprising:

a vacuum envelope with a central longitudinal axis and including a panel section, a funnel section and a neck section, said panel section having a faceplate, a front view shape of which is substantially rectangular and which has an inner surface, and a skirt with a peripheral inner surface extending from a peripheral edge of said faceplate, said funnel section being contiguous to said skirt of said panel section, and said neck section being contiguous to said funnel section;

a phosphor screen formed on said inner surface of said faceplate;

an electron gun assembly, arranged in said neck section, for emitting electron beams to be landed on said phosphor section;

a shadow mask arranged in said panel section to oppose said phosphor screen and having a large number of apertures for allowing passage of electron beams therethrough;

a mask frame for supporting said shadow mask, including corner sections, each of which has a flat outer surface; and support members for supporting said mask frame on said peripheral inner surface of said skirt, each of said support members being provided with a straight plate section and first and second plate sections extending from both ends of said straight plate section, said first plate section being fixed to the flat corner surface of said corresponding corner section, said first plate section and said straight section defining a V-shaped structure, said second plate section being coupled to said inner surface of said skirt and said support member being resiliently deformable.

2. A color cathode ray tube according to claim 1, wherein said second plate section of said support member is coupled to the inner surface of said panel through a stud pin studded in said panel.

3. A color cathode ray tube according to claim 1, wherein said flat outer surfaces of said corner section of said mask frame are substantially parallel to said axis of said vacuum envelope.

4. A color cathode ray tube according to claim 1, wherein said mask frame has a substantially rectangular shape having diagonal axes, and said flat outer surfaces of said corner section thereof are arranged to be substantially perpendicular to the corresponding diagonal axis.

5. A color cathode ray tube according to claim 1, wherein said mask frame has a substantially rectangular shape having diagonal axes, each of said corner sections thereof has a structure that projects along the corresponding diagonal axis and has first and second side edges extending along the diagonal axis, and said flat surface section extends between said first and second side edges, in contact therewith.

6. A color cathode ray tube according to claim 1, wherein said support member comprises a metal plate.

7. A color cathode ray tube comprising:

a vacumm envelope with a longitudinal axis and including a panel section, a funnel section and a neck section, said panel section having a faceplate, a front view shape of which is substantially rectangular and which has an inner surface, and a skirt with a peripheral inner surface extending from a peripheral edge of said faceplate, said funnel section being contiguous to said skirt of said panel section, and said neck section being contiguous to said funnel section;

a phosphor screen formed on said inner surface of said faceplate;

an electron gun assembly, arranged in said neck section, for emitting electron beams which are incident on said phosphor section;

a shadow mask arranged in said panel section to oppose said phosphor screen and having a large number of apertures for allowing passage of electron beams therethrough;

a mask frame for supporting said shadow mask, including corner sections, each of which has a flat outer surface that is substantially parallel to a longitudinal axis of said vacuum envelope; and support members for supporting said mask frame on said peripheral inner surface of said skirt, each of said support members having a straight plate section and first and second plate sections extending from both ends of said straight plate section, said first plate section being fixed to the flat corner surface of said corresponding corner section, said first plate section and said straight section defining a V-shaped structure, said second plate section being coupled to said inner surface of said skirt, said support memeber being resiliently deformable, and said second plate section of said support member being coupled to the inner surface of said panel through a stud pin studded in said panel, said stud pin having a central axis substantially perpendicular to said longitudinal axis.

8. A color cathode ray tube according to claim 7, wherein said mask frame has a substantially rectangular shape having diagonal axes, and said flat outer surfaces of said corner section thereof are arranged to be substantially perpendicular to the corresponding diagonal axis.

9. A color cathode ray tube according to claim 7, wherein said mask frame has a substantially rectangular shape having diagonal axes, each of said corner sections thereof has a structure that projects along the corresponding diagonal axis and has first and second side edges extending along the diagonal axis, and said flat surface section extends between said first and second side edges, in contact therewith.

10. A color cathode ray tube according to claim 7, wherein said support member comprises a bent metal plate.

* * * * *